United States Patent [19]

Hwang

[11] 4,256,610

[45] Mar. 17, 1981

[54] CLEANING COMPOSITION FOR USE IN AN INK JET RECORDER

[75] Inventor: Ki-Sup Hwang, Xenia, Ohio

[73] Assignee: The Mead Corporation, Dayton, Ohio

[21] Appl. No.: 42,679

[22] Filed: May 25, 1979

[51] Int. Cl.[3] ..... C11D 3/60; C11D 9/60

[52] U.S. Cl. ..... 252/542; 252/89.1; 252/174.16; 252/544; 252/546; 252/557; 134/38; 134/40; 134/42; 346/75

[58] Field of Search ..... 252/89.1, 174.16, 544, 252/546, 557; 134/42, 40, 38; 346/75

[56] References Cited

U.S. PATENT DOCUMENTS

| | | | |
|---|---|---|---|
| 3,891,121 | 6/1975 | Stoneburner | 346/75 X |
| 4,031,561 | 6/1977 | Paranjpe | 346/75 X |

*Primary Examiner*—Harris A. Pitlick

*Attorney, Agent, or Firm*—Biebel, French & Nauman

[57] ABSTRACT

A cleaning composition for use in removing ink residues, soil, dust, and other foreign matter from the orifices, fluid manifolds, and fluid lines in an ink jet recording apparatus is provided. The aqueous based composition includes a wetting agent, an electrostatic discharge agent, a fluid viscosity and density adjusting agent, and a pH adjusting agent. Optionally, a metal chelating agent may be included in the composition.

7 Claims, No Drawings

CLEANING COMPOSITION FOR USE IN AN INK JET RECORDER

BACKGROUND OF THE INVENTION

The present invention relates to jet drop recording systems, and more particularly to a composition for cleaning residual ink and any foreign particles from the orifices, fluid manifold, and fluid lines in an ink jet recorder.

Jet drop recording systems typically operate by pumping a liquid coating material such as ink under pressure to a manifold communicating with a series of small diameter orifices. As the coating material is ejected through the orifices under pressure, it forms fine filaments of coating material which break down into a series of discrete drops. At the point where the drops break from the filaments they pass through charging rings which, depending upon the pattern of coating material desired on a receiving member conveyed beneath the drop generator, either charge or do not charge every drop of coating material.

An electrostatic deflecting field is set up downstream of the charge rings and all drops which receive a charge are deflected from their trajectory by the deflecting field. A catcher is also associated with the system to catch those drops which it is desired to prevent from reaching the receiving member. In this manner, a predetermined pattern of drops will print upon the receiving member.

In many jet drop printing systems there are several hundred orifices having diameters ranging from about 0.0007 inches to 0.003 inches in diameter through which ink is forced. As can be appreciated when working with such small openings, formation of absolutely straight ink drop streams precisely aligned to pass through the charge rings and deflection field is critical. When dried ink or other foreign particles accumulate on the walls of the orifice or in other parts of the system such as in the fluid manifold or fluid supply lines, ink jet straightness is adversely affected, which in turn adversely affects the quality of printing of the system. These crooked jets may be caused by obstructions in the orifices which knock the ink jet streams off line or by a pressure drop in the system which causes the jets to wander.

Accordingly, these jet drop recorder systems have had to be cleaned periodically, either prior to or after use, to remove any dried ink, foreign particles, dust, soil, or the like. Prior art cleaning techniques have used either blasts of air, water, or a mixture of water and denatured alcohol to remove the accumulated particles and dust from the system. For example, both Stoneburner, U.S. Pat. No. 3,891,121, and Paranjpe, U.S. Pat. No. 4,031,561, teach use of a flushing fluid during startup of a jet drop recording system consisting of an equal mix of water and alcohol. However, such prior art cleaning techniques have not proved entirely satisfactory. Although most jet printing inks are aqueous based, they are formulated to become water insoluble when dry. Water alone, or a water-alcohol mixture will not wet the dried ink and other foreign particles which accumulate in jet drop recording systems. Moreover, particles which have become electrostatically charged and adhere to the internal walls of the system cannot easily be removed by water alone.

Although various general purpose cleaning solutions are available commercially, they have one or more shortcomings which render them unacceptable for use in jet drop printing systems. Among these shortcomings are problems with foaming, high viscosity, the presence of ammonia or other chemicals incompatible with the ink and mechanical components of the system, and a tendency of form films or leave residues on surfaces. As can be seen, the need exists in the art for a cleaning composition which can effectively remove dried ink, dust, soil, and other foreign particles from an ink jet recording system and yet be compatible with the materials in the system.

SUMMARY OF THE INVENTION

In accordance with the present invention, a cleaning composition for use in removing dried ink, dust, and other accumulated foreign particles from an ink jet recording system is provided. The composition comprises four major functional elements which are a wetting agent, an electrostatic discharge agent, a viscosity and density adjusting agent, and a pH adjusting agent. The composition may optionally include a metal chelating agent.

The aqueous based cleaning composition is free of particulate matter and able to pass through a 0.4 micron filter to insure that it will not clog ink jet orifices. It has a viscosity of between 1 and 5 centipoise at 25° C. and is adjusted to maintain a slightly alkaline pH in the range of from 7 to 10 so that it will not adversely affect metal surfaces. The composition has a surface tension of 30 to 40 dyne/cm at 25° C. to insure that all foreign particles in the system are rapidly wetted. The cleaning composition may be added to the system either prior to startup or immediately after shutdown.

Accordingly, it is an object of the present invention to provide a cleaning composition for effectively removing dried ink, dust, soil, and other foreign matter from an ink jet recording system which is compatible with the materials present in the system. This and other objects and advantages of the invention will become apparent from the following description and appended claims.

DESCRIPTION OF THE PREFERRED EMBODIMENTS

An aqueous base cleaning composition for an ink jet recorder prepared in accordance with the present invention comprises a wetting agent, an electrostatic discharge agent, a viscosity and density adjusting agent, and a pH adjusting agent. Optionally, a metal chelating agent may also be included in the composition.

As the wetting agent, it has been found that electroneutral or nonionic wetting agents such as poly alkyl ethers, oleyl amino-oleate, octylphenoxypropyl ethoxy ethanol, and disodium isodecyl sulfosuccinate having HLB values in the range of from 10 to 15 are effective to penetrate and wet dried ink residue, dust, soil, and any other foreign matter which has accumulated in the system. The above listing of wetting agent is intended to be exemplary and not exhaustive to all suitable compounds. It is within the scope of the invention to utilize any known wetting agent which is capable of rapidly wetting the foreign matter lodged in the system and is compatible with both the components of the system and the other constituents of the composition.

In ink jet recording systems in which the deposition of water hardness causing divalent cations such as calcium, magnesium, and iron is a problem, a metal chelating agent may be added to the cleaning composition. It has been found that the trisodium salt of N-(carboxymethyl)-N-(2-hydroxyethyl)-N-N-ethylene diglycine described in Kroll et al, U.S. Pat. No. 2,845,457, is effective in chelating not only alkaline earth metals but also iron. Addition of from 0.01–3.0% by weight of chelating agent is effective to remove these metals. Alternatively, other known chelating agents such as the salt of hydroxyethylene diamine can be utilized.

Although the wetting agent of the cleaning composition is effective in rapidly penetrating and wetting particles and foreign matter, it was found that such particles were not removed because they were electrostatically charged and clung to system components. This is especially true for foreign matter in any plastic tubing in the system. However, this problem was solved by the addition of from 0.1 to 3.0% by weight of an electrostatic discharge agent to the cleaning composition. For this purpose, the free acid form of the monophosphate ester of an alkoxylated linear primary alcohol having 10 to 15 carbon atoms is effective to remove electrostatically charged particles from system components. While the exact mechanism is not known, it is believed that the discharge agent either retards the buildup of static electricity in the system or promotes rapid discharge of static charges on particles to render them electrically neutral. These alkoxylated primary alcohol monophosphate esters are available under the trade names Klearfac AA-270 and Klearfac 40 from BASF Wyandotte Co., Wyandotte, Mich. Their cloud points should range from 88° C. to 100° C. It is also within the scope of this invention to utilize other known electrostatic discharge agents which are compatible with the other components of the cleaning composition.

Once the foreign particles have been wetted and removed by the cleaning composition, they must be maintained in suspension so that they may be flushed out of the system. For this purpose, a viscosity and density adjusting agent is added to the composition to increase both its voscosity and density. Since the rate of settling of a particle in a fluid follows Stoke's Law of $$V = \frac{K(D_1 - D_2)r^2}{\eta},$$

where V is the settling velocity, K is a proportionality constant, $D_1$ is the density of the particle, $D_2$ is the density of the fluid, r is the radius of the particle, and $\eta$ is the viscosity of the fluid, increasing the density and viscosity of the fluid will slow the rate of settling of particles and help maintain them in suspension for a longer period of time.

For this purpose, it has been found that the addition of from about 2% to 5% of an ethoxylated cellulose having a molecular weight of from 4400 to 30,000 will raise both the viscosity and density of the cleaning composition. For example, the addition of about 2% to 5% by weight hydroxyethyl cellulose will raise the viscosity of the composition to between 1.5 and 5.0 centipoise and increases its density to between 1.1 and 1.2 gm/cm$^3$. Addition of other viscosity and density increasing agents either in place of or in combination with ethoxylated celluloses such as tetraethylene pentamine is also contemplated.

Finally, to prevent any corrosion of metal surfaces in the system, the pH of the cleaning composition is adjusted to a neutral or mildly basic pH of between 7 and 10 by the addition of a basic compound. The addition of between about 0.1 to 2.0% by weight of morpholine has been found to produce a satisfactory pH and to be compatible with the other components of the cleaning composition. Of course, other basic pH producing compounds may be utilized so long as they are compatible with the other constituents of the composition and with the materials in the ink jet recording system.

The following nonlimiting Example is illustrative of the practice of the invention.

EXAMPLE

A cleaning composition for use in an ink jet recording apparatus was made by mixing the following compounds:

| | |
|---|---|
| disodium isodecyl sulfosuccinate | 0.06 (weight %) |
| Klearfac 40 | 0.7 |
| trisodium N-(carboxymethyl)-N-(2-hydroxyethyl)-N-N-ethylene diglycine | 0.7 |
| hydroxyethyl cellulose | 3.0 |
| morpholine | 2.0 |
| balance water | |

The composition was filtered through a 0.4 micron membrane filter to remove any particulate matter. The viscosity of the composition was 1.3 centipoise, and the composition had a specific gravity of 1.121. The composition was circulated through the ink supply and manifold system of an ink jet printer prior to startup. It effectively removed dried ink residues and foreign particles.

While the composition and methods herein described constitute preferred embodiments of the invention, it is to be understood that the invention is not limited to these precise embodiments, and that changes may be made in either without departing from the scope of the invention, which is defined in the appended claims.

What is claimed is:

1. A cleaning composition for an ink jet recording system comprising:

a wetting agent selected from the group consisting of oleyl amino-oleate, octylphenoxypropyl ethoxy ethanol, disodium isodecyl sulfosuccinate, poly alkyl ethers, and mixtures thereof, an electrostatic discharge agent comprising a monophosphate ester of an alkoxylated linear primary alcohol, which alcohol contains from 10 to 15 carbon atoms, a viscosity and density adjusting agent selected from the group consisting of ethoxylated cellulose, tetraethylene pentamine, and mixtures thereof, a pH adjusting agent capable of adjusting the pH of the composition to a range of between 7 and 10, and water.

2. The composition of claim 1 including a chelating agent selected from the group consisting of the trisodium salt of N-carboxymethyl-N-(2-hydroxyethyl)-N-N-ethylene diglycine, sodium-N-hydroxy-ethylene diamine, and mixtures thereof.

3. The composition of claim 1 in which said wetting agent is present in an amount of from 0.01 to 3.0% by weight, said electrostatic discharge agent is present in an amount of from 0.1 to 3.0% by weight, said viscosity adjusting agent is present in an amount of from 2 to 5% by weight, and said pH adjusting agent being present in an amount of from 0.1 to 2% by weight.

4. The composition of claim 2 in which said chelating agent is present in an amount of from 0.01 to 3.0%.

5. A cleaning composition for an ink jet recording system comprising by weight:

0.06% disodium isodecyl sulfosuccinate, 0.7% of a monophosphate ester of an alkoxylated linear primary alcohol containing from 10 to 15 carbon atoms, 0.7% trisodium N-carboxymethyl-N-2 hydroxyethyl-N-N ethylene diglycine, 3.0% hydroxyethyl cellulose, 2.0% morpholine, and balance water.

6. A cleaning composition for an ink jet recording system comprising:

a wetting agent, an electrostatic discharge agent comprising a monophosphate ester of an alkoxylated linear primary alcohol, which alcohol contains from 10 to 15 carbon atoms, a viscosity and density adjusting agent to increase the density and viscosity of the cleaning composition to slow the rate of settling of removed particles and aid in maintaining them in suspension, a pH adjusting agent capable of adjusting the pH of the composition to a range of between 7 and 10, and water.

7. A cleaning composition for an ink jet recording system comprising:

a wetting agent selected from the group consisting of oleyl amino-oleate, octylphenoxypropyl ethoxy ethanol, disodium isodecyl sulfosuccinate, poly alkyl ethers, and mixtures thereof, an electrostatic discharge agent, a viscosity and density adjusting agent selected from the group consisting of ethoxylated cellulose, tetraethylene pentamine, and mixtures thereof, a pH adjusting agent capable of adjusting the pH of the composition to a range of between 7 and 10, and water.

* * * * *